US006050157A

United States Patent [19]

Ludwig et al.

[11] Patent Number: 6,050,157

[45] Date of Patent: Apr. 18, 2000

[54] SETTING TOOL FOR ANCHOR RODS OF ATTACHMENT ANCHORS

[75] Inventors: Wolfgang Ludwig, Schwabmünchen; Erich Leibhard, Munich; Norbert Daam, Oberdiessen, all of Germany

[73] Assignee: Hilti Aktiengesellschaft, Schaan, Liechtenstein

[21] Appl. No.: 09/066,232

[22] Filed: Apr. 24, 1998

[30] Foreign Application Priority Data

Apr. 24, 1997 [DE] Germany ..... 197 17 498

[51] Int. Cl.[7] ..... B25B 13/06

[52] U.S. Cl. ..... 81/121.1; 81/185.1; 81/176.2

[58] Field of Search ..... 81/176.1, 176.15, 81/176.2, 53.2, 52, 120, 121.1, 124.2, 185.1; 279/9.1, 7

[56] References Cited

U.S. PATENT DOCUMENTS

| | | | |
|---|---|---|---|
| 1,536,309 | 5/1925 | Reulman | 81/53.2 |
| 3,656,793 | 4/1972 | Mathews | 81/120 |
| 4,461,195 | 7/1984 | Barnick | 81/176.15 X |
| 4,880,245 | 11/1989 | Autrey | 81/120 X |
| 4,930,378 | 6/1990 | Colvin | 81/121.1 |
| 5,509,332 | 4/1996 | Donaldson, Jr. | 81/121.1 X |

*Primary Examiner*—D. S. Meislin
*Attorney, Agent, or Firm*—Brown & Wood, LLP

[57] ABSTRACT

A setting tool for anchor rods of attachment anchors, which have a rear end section (P) having a polygonal cross-section, the setting tool including a housing (2) provided with an insertion end receivable in a chuck of a percussion rotary drill and a rod receptacle (5) provided at an end of the housing opposite, in an axial direction (A), to the insertion end (5), the rod receptacle (5) having an axially extending inner surface (6) provided with at least two ribs (7) projecting therefrom and extending in the axial direction (A), with the ribs (7) defining an inscribed cylinder (Z) having a diameter (x) larger by from about 0.05 mm to about 0.5 mm than a diameter (y) of a circle (K) inscribed in a polygonal cross-section of the rear and section (P) of the anchor rod.

8 Claims, 2 Drawing Sheets

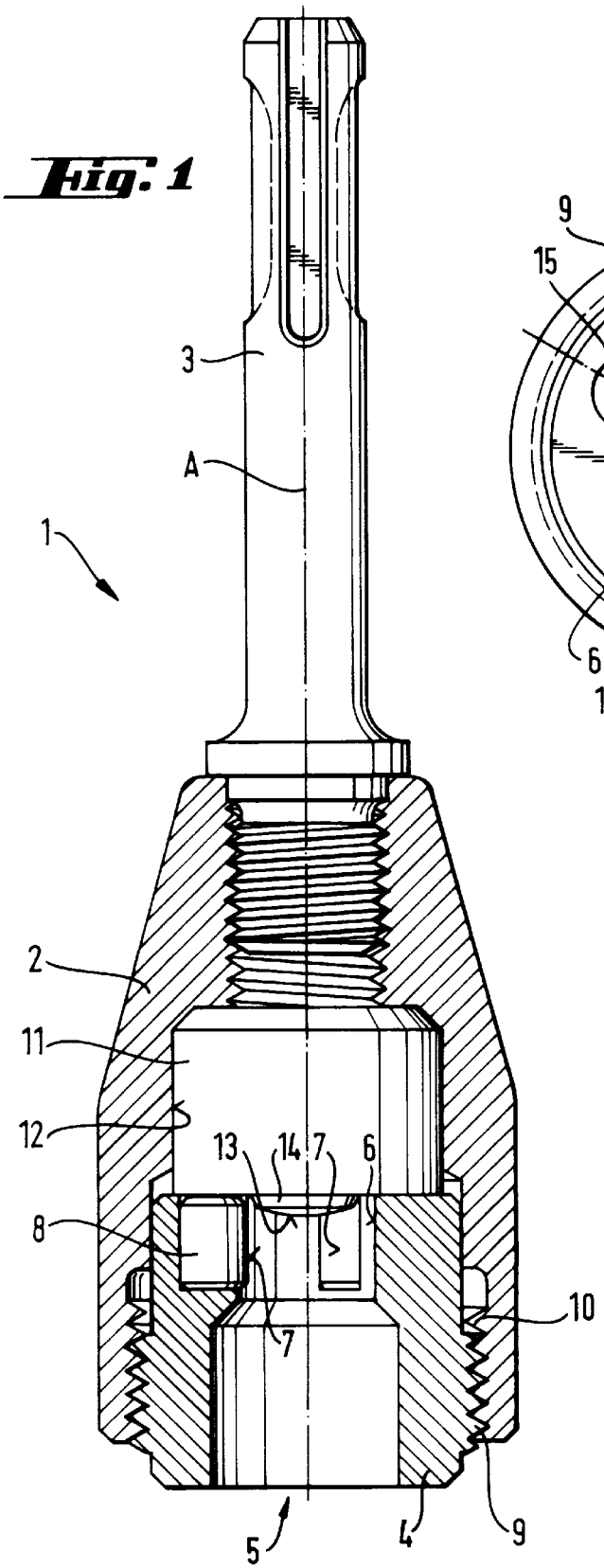
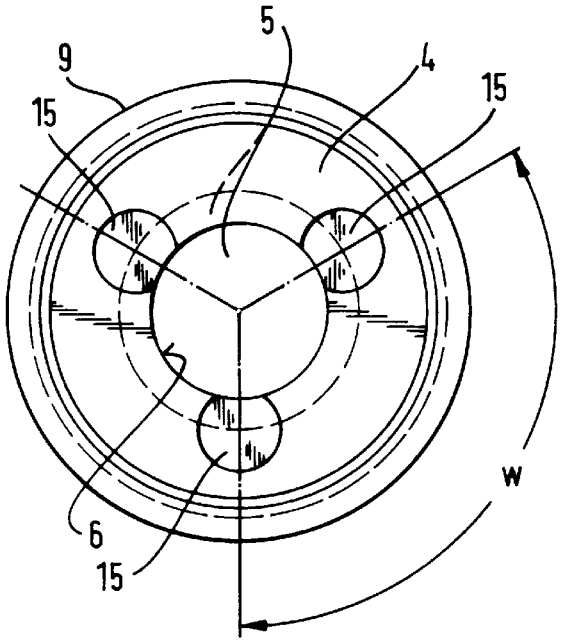
Fig. 2

SETTING TOOL FOR ANCHOR RODS OF ATTACHMENT ANCHORS

BACKGROUND OF THE INVENTION

1. Field of the Invention

The present invention relates to a setting tool for anchor rods of attachment anchors, which have a rear end section having a polygonal cross-section, with the setting tool including a housing provided with an insertion end receivable in a chuck of a percussion rotary drill, and a rod receptacle provided at an end of the housing opposite, in an axial direction, to the insertion end.

2. Background of the Invention

Attachment anchors represent attachment systems which includes an anchor rod and organic or inorganic mortar mass. The anchor rod is secured in a preliminary formed bore with a mortar mass. The anchor rod has, at its end projecting from the bore, load application means, e.g., an outer thread for attachment of a constructional element. For securing an anchor rod in a bore, first, the bore is filled with a mortar mass, and then the anchor rod is inserted into the bore filled with the mortar mass. For increasing the structural strength, usually, a filler material and/or aggregate is admixed to the mortar mass which makes the insertion of an anchor rod into a mortar-filled bore more difficult. The mortar mass and, if necessary, the filler mass and/or aggregate, on many occasions are contained in special containers which are placed into the bore in an untorn condition. The containers can be formed, e.g., as glass ampulla or foil sacks which should be broken when an anchor rod is inserted. Further, the mortar mass and the filler material and/or the aggregate has to be mixed very well to achieve a uniform distribution over the bore depth. When multi-component mortar systems are used, e.g., inorganic systems on a resin-hardener basis, as good as possible intermixing of components is necessary to insure a complete hardening of the mortar mass.

The mixing of the mortar mass and the filler material and/or aggregate is effected by rotating the anchor rod during its insertion into the bore. In addition to rotation about its axis, an anchor rod is subjected to axial impacts. The axial impacts promote the destruction of containers and facilitate the insertion of the anchor rod into a bore filled with a mortar mass, filler material and/or aggregate, and the residues of the containers.

The rotation of the anchor rod and the application of axial impacts is effected with a percussion rotary drill, e.g., a hammer drill of the assignee herein. Because anchor rods have no insertion ends adapted to be received in the chuck of a hammer drill, setting tools are used which are provided with an insertion end adapted to be received in the chuck of a hammer drill, on one hand, and with a receptacle for receiving the rear end of an anchor rod, on the other hand. The setting tool transmits a torque to the anchor rod as well as axial impacts generated by the hammer drill. To this end, the anchor rod is provided at its rear end with an end section having a polygonal, preferably, a hexagon cross-section. The receptacle has corresponding entraining surfaces in a form of a plug-in socket which cooperate with the surfaces of the rear end section of an anchor rod for transmitting the torque. The free end of the anchor rod end section is subjected to axial impacts generated by the hammer drill.

However, a drawback of the known setting tool consists in that the entraining surfaces of the receptacle can jam the corresponding entrained surfaces of the anchor rod end section. Therefore, it can be difficult to remove the setting tool after the anchor rod is set in. Therefore, as a rule, the removal of a setting tool should be delayed until the mortar mass in the bore hardens. Therefore, when a number of anchor rods need be inserted, always several setting tools should be available in order to be able to insert several anchor rods one after another without interruption. The force, which is required to pull the setting tool of the anchor rod, can result in loosening of an attachment anchor in a bore so that the attachment point does not have the required retaining value and becomes unfit.

German Patent No. 4,301,582 discloses a socket-like screw drill the receptacle of which has three rolling bodies aligned in an axial direction. The rolling bodies are spaced from each other by an angular distance of 120° and radially arranged relative to each other with control surfaces. The radial adjustment of the rolling bodies takes place upon rotation of the screw drill housing. At that, an end of a screw inserted into the receptacle is clamped and is capable of transmitting a torque. The known screw driver is applicable for screwing-in processes without application of axial impacts. In case of application of axial impacts, the rolling bodies, which clamp the screw end, can dig into the entrained surfaces or be cold welded thereto as a result of application of pulsed impacts. The pulsed impacts can also result in deformation or even in destruction of the control surfaces which would adversely affect the functioning of the screw drill or would make it totally unfit.

Therefore, an object of the present invention is a setting tool for anchor rods of attachment anchors with which during rotational setting of an anchor rod with simultaneous application of axial impacts, jamming of the entrained surfaces of the anchor rod end section is prevented. The setting tool should be easily removable after the completion of a setting process and be immediately ready for an insertion of another anchor rod.

SUMMARY OF THE INVENTION

These and other objects of the present invention, which will become apparent hereinafter, are achieved by providing a setting tool for anchor rods of attachment anchors, which have a rear end section having a polygonal cross-section, with the setting tool having a housing provided with an insertion end receivable in a chuck of a percussion rotary drill and, in particular a hammer drill, and a rod receptacle provided at an opposite end of the housing for receiving the rear end section of the anchor rod. The receptacle has an axially extending inner surface provided with at least two ribs projecting from the inner surface and extending in the axial direction. The arrangement of the ribs is so selected that a cylinder tangentially inscribed within the ribs has a diameter larger than a diameter of a largest circle inscribed in a polygonal cross-section of the rear end section of the anchor rod by from about 0.05 mm to about 0.5 mm.

The construction of the receptacle according to the present invention significantly reduces the danger of jamming of the setting tool on an anchor rod. The anchor rod is not held any more by being clamped. Thereby, cold welding of the entraining surfaces of the rod receptacle ribs with the rear end section of the anchor rod is prevented. The torque transmission is effected by a form-locking connection resulting, during the rotation of the anchor rod, from geometrical relationships according to the present invention between the stationary axially extending ribs and the entrained surfaces of the end section of an anchor rod. The difference, according to the present invention, between the diameter of a cross-section of a cylinder, which is inscribed between the ribs, and the diameter of a circle, which is inscribed into the polygonal cross-section of the end section of the anchor rod, a small clearance is provided between the rod receptacle and the end section of the anchor rod. As a result, during the rotation of the anchor rod, the receptacle can slightly pivot relatively to the anchor rod until the ribs engage the entrained surfaces of the anchor rod end section and transmit the torque by so-formed form-locking connection. Upon completion of the rotation of the anchor rod, the anchor rod, because of the clearance, becomes disengaged from the ribs. Therefore, upon the completion of the setting process, the setting tool can be immediately removed from the rear end section of the anchor rod. Because of the clearance, practically, no pulling force acts on the anchor rod during the pulling-off of the setting tool. Therefore, the setting tool can be immediately removed after the completion of a setting process, and a danger of loosening of the anchor rod is eliminated.

According to an advantageous embodiment of the present invention, which is used with conventionally used anchor rods the rear end section of which has a hexagon cross-section, there are provided, in the receptacle, three ribs spaced from each other by an angular distance of 120° and projecting from a substantially cylindrical inner surface of the rod receptacle. The cylindrical receptacle can be easily manufactured. The ribs are uniformly distributed along the inner surface and provide for a uniform torque transmission to the entrained surfaces of the end section of the anchor rod.

The service life of the setting tool is increased when the ribs, which operationally engage the entrained surfaces, and the inner surface of the rod receptacle are formed of a hard material.

Advantageously, the ribs are formed as surface portion of surfaces of cylindrical pins formed of a hard material. It is particularly advantageous when the cylindrical pins are replaceably arranged in the receptacle. In this way, the cylindrical pins can be easily replaced if worn off, which further increases the service life of the setting tool.

When the receptacle is provided in a replaceable insert, which is releasably secured in the setting tool housing, preferably is screwed in, can the entire torque transmitting part of the settling tool be easily replaced when necessary. The replaceable insert facilitates the insertion of the cylindrical pins. Their axial retention is facilitated when blind bores are formed in the insert and which are open at the inner surface and are closed at the receptacle mouth. In this way, it is insured that even if the cylindrical pins are loosened as a result of application of axial impacts, they cannot fall-out of their axial position.

It is advantageous when the position of the rod receptacle for the end section of an anchor rod is limited in the axial direction by a stop which is replaceably supported in the setting tool housing. The stop serves for transmission of axial impacts, which are generated by the hammer drill, to the anchor rod via its inserted end section. Because it is loosely supported in the setting tool housing, it can be easily replaced when weared off.

For preventing of a permanent connection of the end section of the anchor rod with the free end of the rod receptacle, it is advantageous when the stop surface of the stop, which is located adjacent to the receptacle and which extends transverse to the inner surface of the receptacle, is provided with a projection which projects from the stop surface by from about 0.5 mm to about 4 mm and which is formed of a hard material. The selected geometry of the projection prevents jamming of the anchor rod end. Because the projection, which contacts the anchor rod, is made of a hard material, the end of the anchor rod, which is usually made of a weaker material, can be slightly deformed. However, cold welding of the projection with the usually galvanized end of the anchor rod is prevented. According to a preferable geometry of the projection, it has a lens-like shape and a radius of from about 10 mm to about 40 mm.

In order to insure universal use of the settling tool, the insertion end of the tool is releasably connected with the setting tool housing. In this way, the setting tool can be used with different chucks of hammer drills. E.g., a cylindrical insertion end can be used with a jaw-chuck of a hammer drill, and a hexagon insertion end with a corresponding chuck of hammer drill.

BRIEF DESCRIPTION OF THE DRAWINGS

The features and objects of the present invention will become more apparent, and the invention itself will be best understood from the following detailed description of the preferred embodiments when read with reference to the accompanying drawings, wherein;

FIG. 1 shows a partially cross-sectional view of a setting tool for anchor rods of attachment anchors according to the present invention;

FIG. 2 shows a view of a rear end of an insert with an anchor rod receptacle.

DETAILED DESCRIPTION OF THE PREFERRED EMBODIMENT

Figure 3:
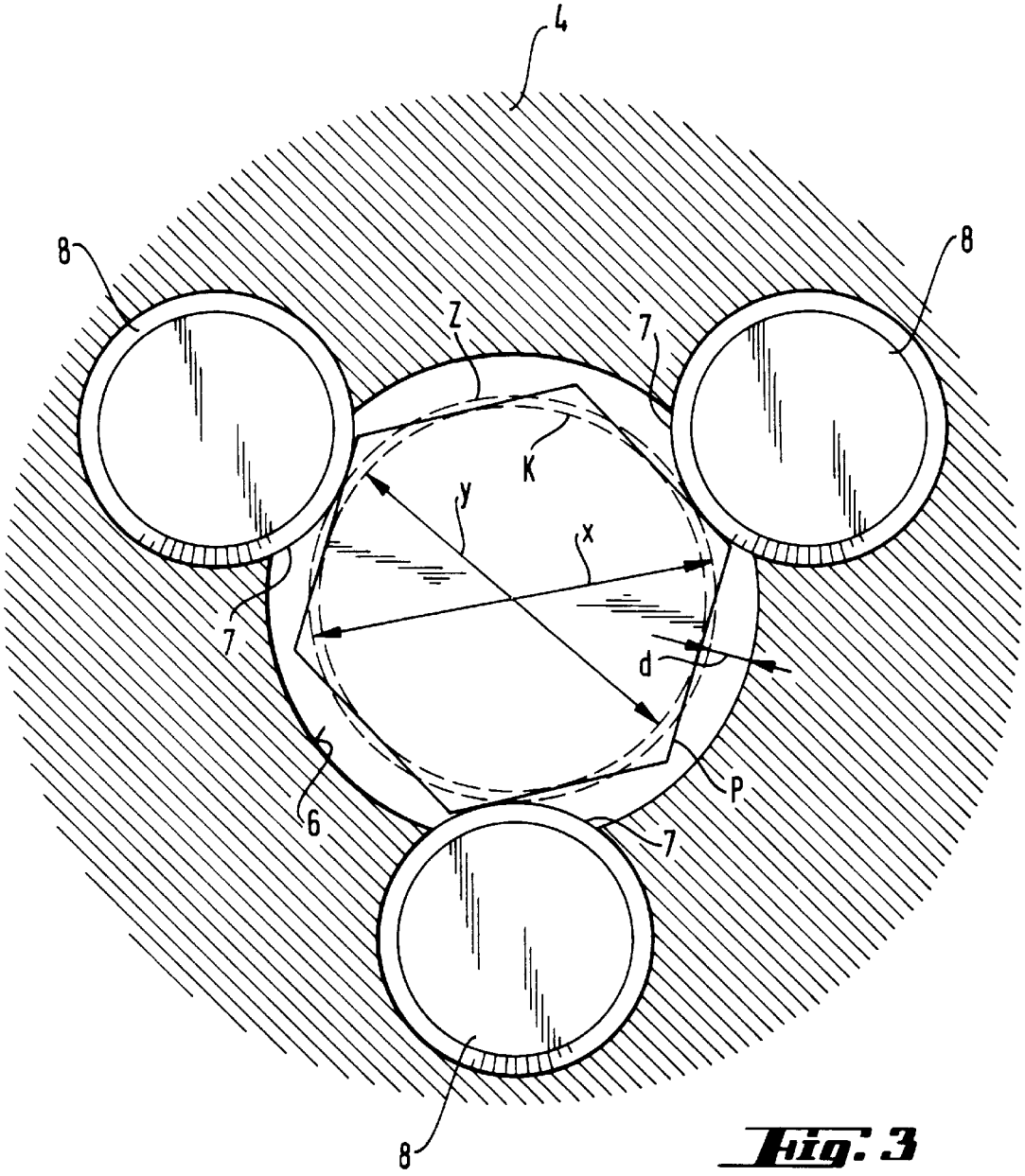
FIG. 3 shows a schematic view of a cross-section of the setting tool according to the invention illustrating geometrical relationship in the region of the anchor rod receptacle.

FIG. 1 shows an embodiment of a tool for setting anchor rods of attachment anchors according to the present invention and which is generally designated with a reference numeral 1. The longitudinal axis of the setting tool 1 is designated with a reference sign A. The setting tool 1 includes a housing 2 provided at its rear end with an insertion portion 3 receivable in a chuck of a percussion rotary drill, e.g., a hammer drill of the assignee of the present invention. In an advantageous embodiment of the present invention, the insertion portion of the insertion end 3 is releasably connected with the housing 2 of the setting apparatus 1, as shown in FIG. 1, e.g., is screwed in. The housing 2 is open at its end, which lies opposite from the insertion end 3 in the axial direction, and is provided there with a rod receptacle 5 for receiving the rear end of an anchor rod. As shown in FIG. 1, the rod receptacle 5 is provided in an insert 4 having an outer thread 9 which is screwed in the inner thread 10 provided at the open end of the housing 2. The rod receptacle 5 is formed as substantially rotationally symmetrical axial bore provided in the insert 4 and extending along the entire length of the insert 4. This bore can have a constant diameter over its entire length. However, as shown, it can be formed as a stepped bore in which the entrance region has a larger diameter than the inner bore section is the housing 2. The wider entrance region facilitates the insertion of the anchor rod into the rod receptacle 5.

In the bore section having a smaller diameter, there are provided axial ribs 7 projecting from the inner surface 6 of the bore. The axially extending ribs 7 are formed by the surfaces of cylindrical pins 8 which are held with a press fit in blind bores. The blind bores are opened at the inner surface 6. In this way, portions of the surfaces of the cylindrical pins 8 project beyond the cylindrical inner surface 6 of the insert bore.

Inside the housing 2, the insert 4 abuts a stop 11. The stop 11 is loosely arranged in the bore portion 12 of the housing 2 and is fixed with respect to the housing 2 by the screwed-in insert 4. A stop surface 13 of the stop 11, which is adjacent to the rod receptacle 5, is provided with a projection 14 which projects from the stop surface 13 by from about 0.5 mm to about 4 mm. Preferably, the projection 14 is lens-shaped and has a radius from about 10 mm to about 40 mm. The projection 14 and the cylindrical pin 8, which partially project beyond the inner surface 6 of the housing bore, are formed of a hard metal.

FIG. 2 shows an end surface of a section of the insert 4 arranged inside of the housing 2. The backward opening of the rod receptacle 5 can be clearly seen. The region of the insert bore having a larger diameter is shown with dash-dot line. The circumference of the insert 4 is provided with an outer thread 9. Also shown are blind bores 15 opening into the rear end surface of the insert 4. In the embodiment shown in the drawings, there are provided three blind bores 15. The blind bores 15 are spaced from each other by the same angular distance W along the inner surface 6 of the housing bore. When three blind bores 15 are provided, the angular distance W is equal to 120°.

The schematic view of FIG. 3 shows geometrical relationships between the rod receptacle 5 and an end section P of an anchor rod which need be set in a constructional component. The end section P has, as shown, a cross-section of a regular hexagon. The axially extending cylindrical pins 8 have portions of their cylindrical surfaces projecting beyond the inner surface 6 and forming axially extending rigid ribs 7 uniformly arranged along the inner surface 6. The ribs 7 define a cylinder a cross-section Z of which is designated with a reference sign Z and shown with dash lines. The circular cross-section Z has a diameter x. The diameter of a circle K inscribed into the cross-section of the end section P is designated with a reference sign y. The cross-section Z and the circle K are concentric with each other. According to the present invention, the diameter x of the cross-section Z exceeds the diameter of the inscribed circle K by from about 0.05 mm to about 0.5 mm. Thereby, the anchor rod does not become jammed in the receptacle 5, and the receptacle 5 is capable of being slightly rotated around the anchor rod until the rigid ribs 7 form a form-locking connection with rotating entrained surfaces of the hexagon end section P of the anchor rod. Advantageously, the receptacle 5 has a cylindrical inner surface coinciding with the inner surface 6. With the arrangement of the rigid ribs 7 according to the present invention, the cross-section Z is spaced from the inner surface 6 in regions between the ribs 7 by the same distance d.

The setting tool according to the present invention prevents clamping or cold welding of operationally connected rotating entrained surfaces during the setting process. The inventive setting tool is easy to use and is easily releasable after setting of the anchor rod. The regions of the setting tool, which become operatively connected with an anchor rod during the setting process are formed of hard metal. The construction of the inventive setting tool is simple, and it can be economically produced. It enables an easy exchange of components subjected to wear which increases the setting tool durability.

Though the present invention was shown and described with references to the proffered embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A setting tool for anchor rods of attachment anchors which have a rear end section (P) having a polygonal cross-section, the setting tool comprising a housing (2) provided with an insertion end receivable in a chuck of a percussion rotary drill; a receptacle (5) provided at an end of the housing opposite, in an axial direction (A), to the insertion end for receiving an anchor rod, the anchor rod receptacle (5) having an axially extending inner surface (6) provided with at least two ribs (7) projecting therefrom and extending in the axial direction (A), the ribs (7) defining an inscribed cylinder (Z) having a diameter (x) larger by from about 0.05 mm to about 0.5 mm than a diameter (y) of a largest circle (K) inscribed in a polygonal cross-section of the rear end section (P) of the anchor rod; and a stop (11) replaceably supported in the housing (2) for limiting a position of the receptacle (5) in the housing (2) in the axial direction (A), wherein the receptacle (5) is provided in an insert (4) releasably securable in the housing, and wherein a stop surface (13) of the stop (11), which is located adjacent to the receptacle (5) and extends transverse to the inner surface (6) thereof, has a projection (14) formed of a same hard material as the inner surface (6) and projecting from the stop surface (13) by from about 0.5 mm to about 4 mm.

2. A setting tool according to claim 1, comprising three ribs (7) extending parallel to each other and spaced from each other by an angular distance (W) of 120°.

3. A setting tool according to claim 2, wherein the ribs (7) and the inner surface (6) are formed of a hard material.

4. A setting tool according to claim 2, wherein the ribs (7) are formed by surfaces of cylindrical pins (8) formed of a hard material and replaceably secured in the rod receptacle (5).

5. A setting tool according to claim 2, wherein the receptacle (5) is provided in an insert (4) releasably securable in the housing (2).

6. A setting tool according to claim 5, wherein the insert (4) has an outer thread (9) cooperating with an inner thread (10) of the housing (2) for securing the insert (4) in the housing (2).

7. A setting tool according to claim 1, wherein the projection (14) is lens-shaped and has a radius from about 10 mm to about 40 mm.

8. A setting tool according to claim 1, wherein the insertion end (3) is releasably connected with the housing (2).

* * * * *